US007152345B2

(12) United States Patent
Koenig

(10) Patent No.: US 7,152,345 B2
(45) Date of Patent: Dec. 26, 2006

(54) THERAPEUTIC VIBRATING SHOE

(76) Inventor: Richard D. Koenig, 14120 Stirling Rd., Fort Lauderdale, FL (US) 33330

( * ) Notice: Subject to any disclaimer, the term of this patent is extended or adjusted under 35 U.S.C. 154(b) by 0 days.

(21) Appl. No.: 10/733,886

(22) Filed: Dec. 12, 2003

(65) Prior Publication Data

US 2005/0126049 A1 Jun. 16, 2005

(51) Int. Cl.
*A43B 23/00* (2006.01)

(52) U.S. Cl. ..... 36/136; 601/46

(58) Field of Classification Search ..... 36/136, 36/132, 141; 601/46

See application file for complete search history.

(56) References Cited

U.S. PATENT DOCUMENTS 2,931,893 A * 4/1960 Quijano et al. ..... 36/1
4,802,463 A * 2/1989 Rojas ..... 601/70
5,113,850 A * 5/1992 Larremore et al. ..... 601/46
5,269,081 A * 12/1993 Gray ..... 36/136
5,592,759 A * 1/1997 Cox ..... 36/141
5,836,899 A * 11/1998 Reilly ..... 601/46
5,913,838 A * 6/1999 Reilly ..... 601/58
6,122,846 A * 9/2000 Gray et al. ..... 36/136
6,464,654 B1 * 10/2002 Montgomery et al. ..... 601/46

* cited by examiner

*Primary Examiner*—Ted Kavanaugh

(57) ABSTRACT

A soft body shoe with a semi-rigid molded unit-bottom sole having a self-contained battery powered vibrator mechanism built in to the sole at the arch. The sole of the shoe so constructed as to transmit vibrations through the entire bottom of the shoe, and into the wearer's foot. In addition, battery power is rechargeable via an adapter port in the rear part of the heel of each shoe

1 Claim, 5 Drawing Sheets

THERAPEUTIC VIBRATING SHOE

BACKGROUND

This invention uses, for illustration purposes only, as a matrix, the closed-toe shoe illustrated, (FIGS. 11, 12, 13, 14) in U.S. Pat. No. 6,212,798 as a model for the invention. The specific design of the closed-toe shoe should not be considered part of this patent application.

1. Field of Invention

This invention relates to shoes and devices used to give relief to tired, achy feet, specifically following prolonged activity.

2. Prior Art

Persons that stand for long periods or walk excessive distance during a normal day are subject to tired, achy feet which may be compounded by swelling. Traditionally, these persons will desire the removal of their shoes at the earliest opportunity. Often they have soaked their feet and massaged them to reduce discomfort.

Thereafter, inventors created various whirlpool bath machines that allowed water to be swirled causing a massaging effect on the foot. Other portable machines warmed water or allowed warm water to be kept warm while having a vibrating action employed to bring comfort. Still other machines had a vibrating platform with which to apply the feet, for the same desired effect. The difficulty with each modality is the lack of portability, the machines being cumbersome and heavy, especially those that are filled with water. Vibrating machines are heavy to move, difficult to store and require that the user be stationary during therapy sessions.

My current invention is an improved way to bring comfort to therefore mentioned condition, with the advantage of portability while allowing ambulation.

OBJECTS AND ADVANTAGES

Accordingly, among the objects and advantages of the present invention include:

(a) Lightweight construction of the therapeutic vibrating shoe;

(b) Portability of having a soothing modality included in a shoe;

(c) The person using the Therapeutic Vibrating Shoe does not have to maintain a single position, but can move about while soothing vibration is being applied;

(d) Therapy can be appreciated while a person is in transit, as in riding in a car or flying on an airplane;

(e) The person using the Therapeutic Vibrating Shoe may choose to remain seated with feet elevated or dependent, reclining, supine, prone or ambulatory while soothing vibration is experienced but feet are enclosed and thus body warmth is preserved;

(f) This type of shoe/therapy construction is inexpensive, therefore making this type of soothing vibratory therapy affordable.

DRAWING FIGURES

DESCRIPTION

Figure 1:
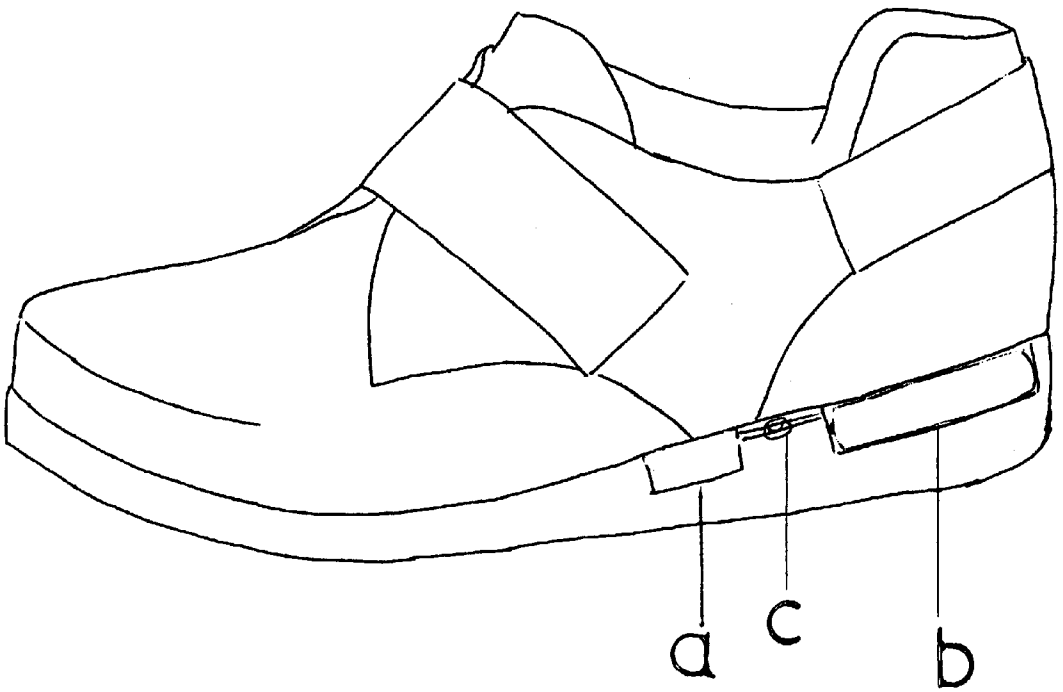
FIG. 1 is outside lateral view of shoe revealing vibrator motor (a) installed in central arch of the sole of the shoe, battery source pack (b) installed in the heel of the sole of the shoe, and wiring harness (c) from battery source pack (b) to vibrator motor (a).
Figure 2:
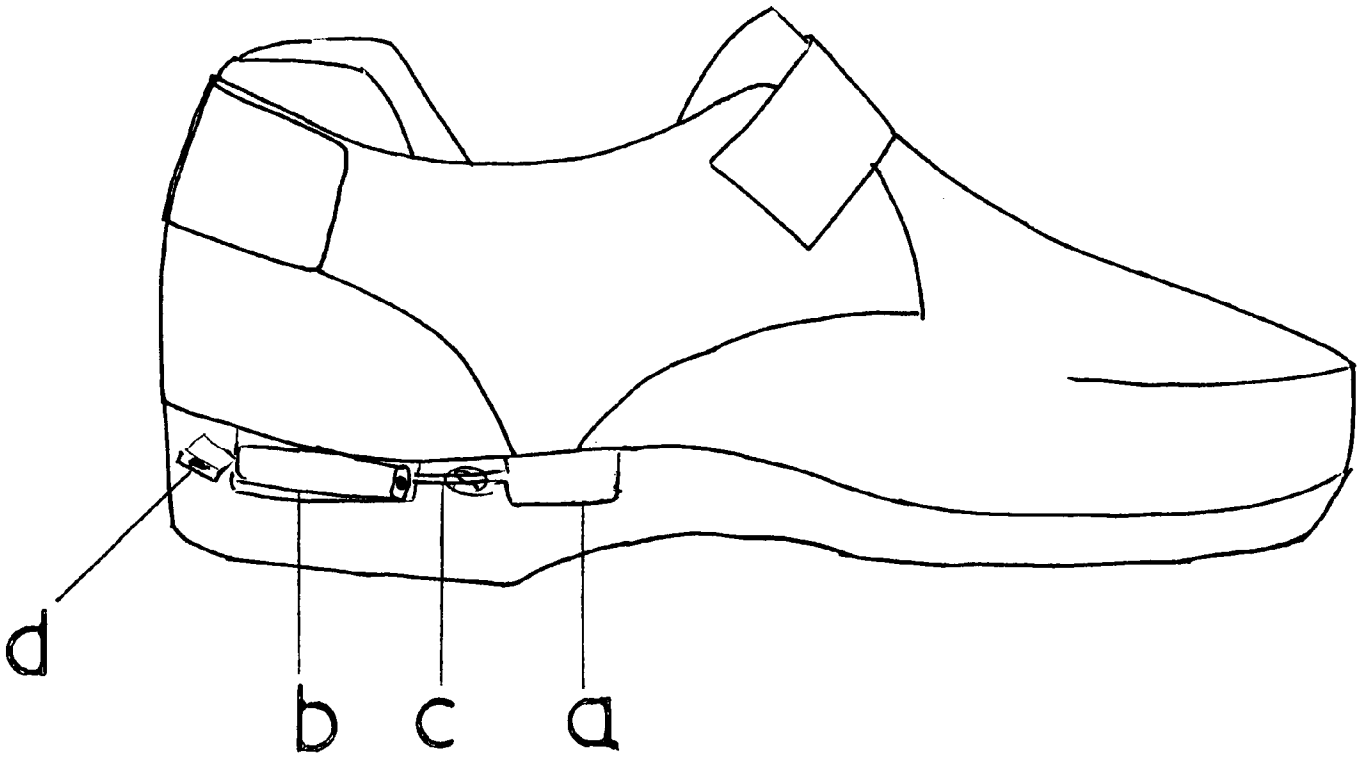
FIG. 2 is inside medial view of shoe revealing vibrator motor (a) installed in central arch of the sole of the shoe, battery source pack (b) installed in the heel of the sole of the shoe, wiring harness (c) from battery source pack (b) to power on/off switch (d) and then to vibrator motor (a).

A typical embodiment of the vibrator of the present invention is illustrated in FIG. 1 (outside lateral view) and FIG. 2 (inside medial view). The vibrator motor is mounted in the sole of the shoe in the central region of the arch. One section of the center framework of the sole has been removed to accommodate the vibrator motor. The motor is cemented in place. In the preferred embodiment of the shoe, the sole is injection-molded polyurethane. The battery pack frame is installed in the heel of the sole and cemented in place, with an access door in the lining and insole of the shoe to allow battery change. An on/off switch is mounted through the medial wall of the sole at the heel. Wiring is through small channels in the sole framework, so that wiring is flush inside the sole. The circuitry consists of a direct wire from the negative pole of the battery pack to the vibrator motor. The wire from the positive pole of the battery pack is interrupted by the on/off switch and continues on to the positive pole entering the motor.

Figure 3:
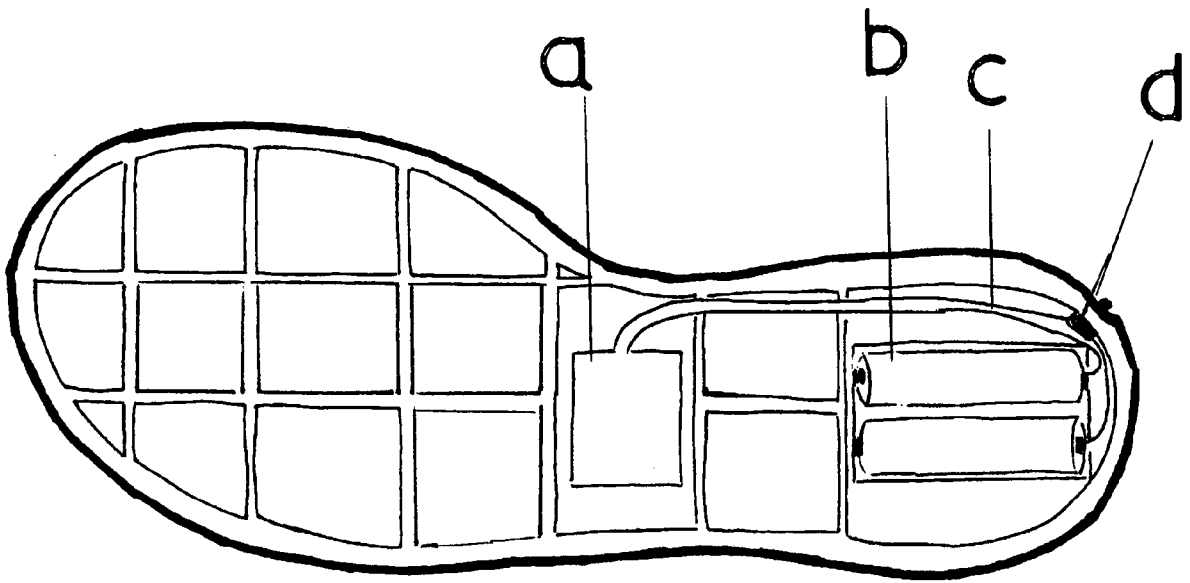
FIG. 3 is top view reveal of the sole of the shoe with vibrator motor (a), connected to wiring harness (c), connecting to power on/off switch (d) and making connection with battery source pack (b).
Figure 4:
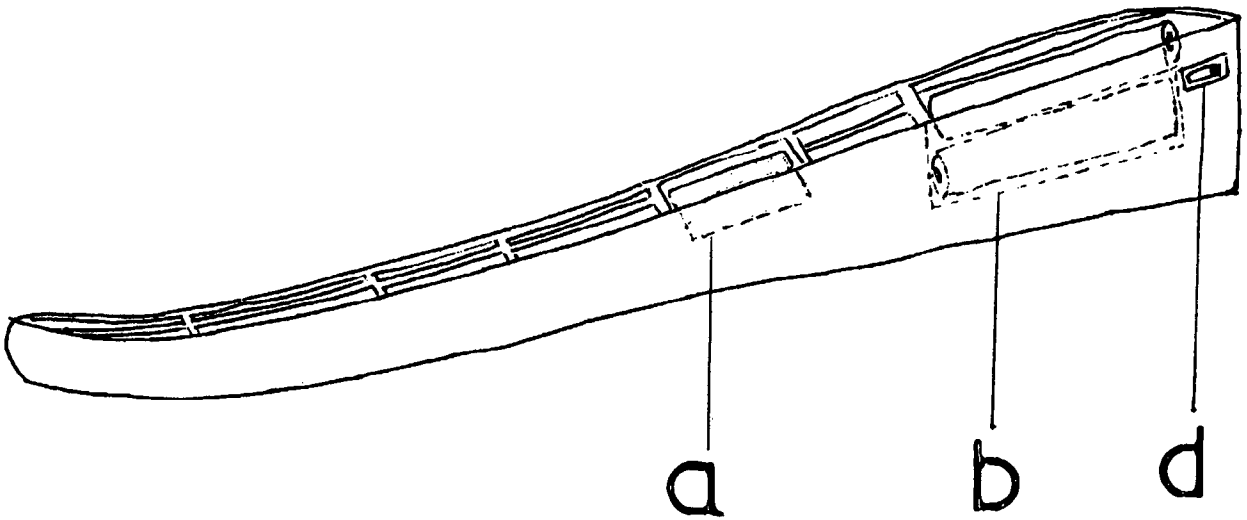
FIG. 4 is medial inside view of sole of shoe containing vibrator motor (a), battery source pack (b), and power on/off switch (d).
Figure 5:
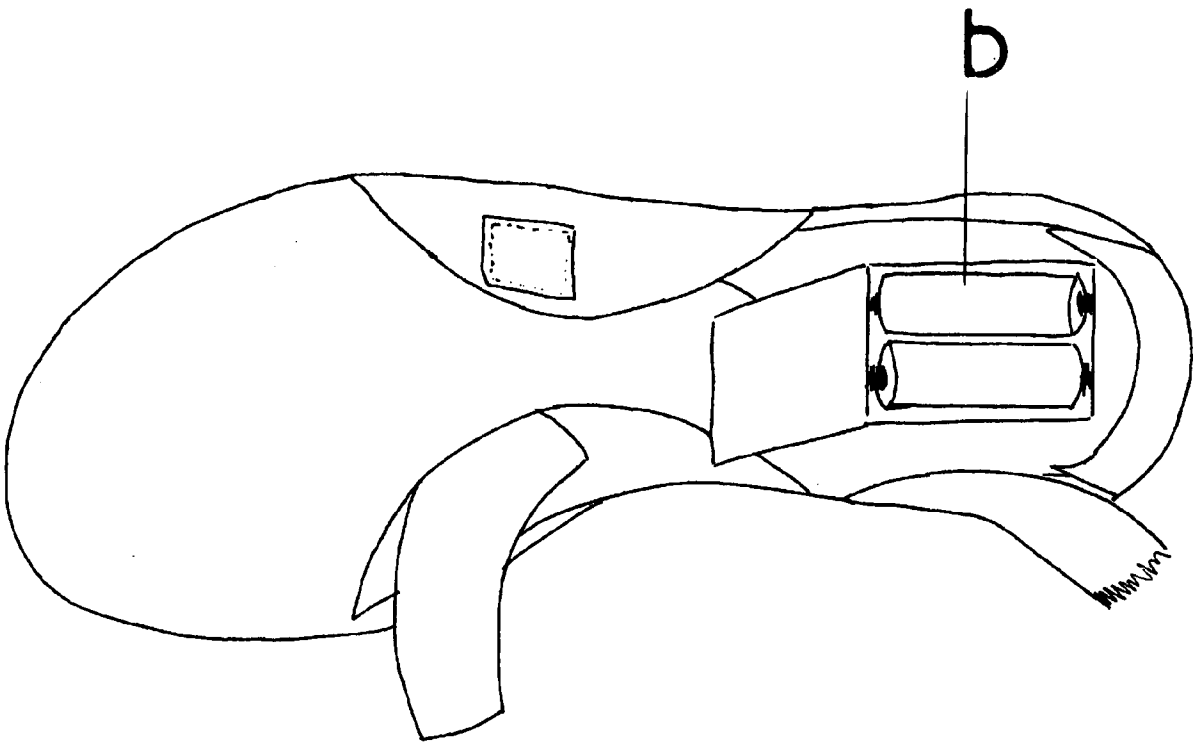
FIG. 5 is top view of shoe revealing inside of shoe to expose hatch for accessibility to battery source pack (b).

Additional illustrations of the embodiment of the vibrator mechanism in the sole are shown in FIG. 3 (top view) and FIG. 4 (side view). FIG. 5 (top view of completed shoe) shows the access to battery pack.

OPERATION

The vibrator is an electric motor and short armature to which is mounted an eccentric lobe, and housed in a plastic box. As the motor spins, off-balance of the eccentric lobe causes vibration. Vibration frequency is estimated at 5000 revolutions per minute. The vibration is translated into the motor housing and then into the sole of the shoe. The vibrations are transmitted from the motor housing, radiating to the toes of the foot through the axis of the framework of sole of the shoe and at the same time, radiate to the heel of the foot. With the strategic placement of the vibrator motor, soothing vibration is perceived throughout the foot, dissipating at the level of the ankle joint. The power source is 2 AAA batteries in series creating 3 volts of current.

The theory of the vibrating shoe' therapeutic action is related to the concept of temporarily increased circulation to a vibrating muscle. This increase in circulation causes the removal of built-up lactic acid in the muscles, creating soreness. Lactic acid accumulation is the result of muscle activity during fatigue. In addition, vibration has long been recognized as a soothing sensation to the body. There may be some transient heat increase as a result of increased muscular circulation. Gentle increases in heat have also, long been recognized as soothing to the body.

SUMMARY, RAMIFICATIONS, AND SCOPE

Accordingly, the reader will see that the invention, the vibrating shoe can be used to comfort the feet following activity. This form of foot comfort is portable, allowing movement around the abode while receiving this treatment. In addition, the vibrating shoes can be used while riding in a car, airliner and other forms of travel. Vibrating shoes are lightweight and are powered by 2 AAA batteries, allowing for shoes to be carried in personal luggage and therefore may be used on business and pleasure trips in hotels or other guest facilities, without the need for power converters. The vibration treatment of the feet with the vibrating shoe has many advantages over previous modalities because;

- it is personal and will not disturb others in a public place therefore can be used during long waiting in terminals;
- it is self-contained and does not require hook-ups, so the user is free to move about;
- it does not require water in a basin as a vehicle to translate vibration into the foot and is therefore not messy or dangerous;
- it does not require AC or DC current to power the vibrator source and is therefore portable and useable in any environment;
- it is contained within the confines of a soft shoe with a semi-firm sole and therefore maintains body warmth and uses the body warmth to augment soothing treatment;
- it employs inexpensive parts and technology therefore making this form of treatment, inexpensive and affordable.

Although the description above contains many specificities, these should not be construed as limiting the scope of the vibrating shoe but as merely providing illustrations of some of the presently preferred embodiments of this invention. For example, the shoe can have other shapes such as a broader, less contoured sole and closure configurations such as elastic strap closure instead of hook and loop strap closure. The on/off switch could be a push button instead of a sliding switch.

Thus the scope of the invention should be determined by the appended claims and their legal equivalents, rather than by the examples give.

I claim:

1. A therapeutic vibrating shoe comprising a wearable soft-bodied fabric shoe, said shoe comprising:

(a) a semi rigid unit bottom sole with longitudinal and transversely crossing ribs forming a framework throughout the entire bottom sole, whereby vibration is transmitted throughout the entire bottom of the shoe and therefore to the entire foot, (b) a vibrator motor incorporated into the sole at a mid-arch of the shoe that produces soothing vibration, (c) a self contained batter pack, power-source incorporated in a heel of the sole of the shoe that is rechargeable via a port in a rear area of the sole that accepts a three volt AC adapter, (d) an on/off power switch incorporated in the heel and available to the outside of the heel on a medial surface, and (e) a self-contained vibrating modality for the soothing treatment of the foot, allowing freedom of movement while soothing treatment ensues, opportunity to use vibrating treatment in remote localities, portability due to lightweight materials and construction.

* * * * *